US008933977B2

(12) United States Patent
Liu et al.

(10) Patent No.: US 8,933,977 B2
(45) Date of Patent: Jan. 13, 2015

(54) METHODS AND SYSTEMS FOR GENERATING DIFFERENTIAL GLOSS IMAGE USEFUL FOR DIGITAL PRINTING

(75) Inventors: Chu-heng Liu, Penfield, NY (US); Timothy David Stowe, Alameda, CA (US)

(73) Assignee: Xerox Corporation, Norwalk, CT (US)

( * ) Notice: Subject to any disclaimer, the term of this patent is extended or adjusted under 35 U.S.C. 154(b) by 66 days.

(21) Appl. No.: 13/539,421

(22) Filed: Jun. 30, 2012

(65) Prior Publication Data

US 2014/0002572 A1 Jan. 2, 2014

(51) Int. Cl.

| | |
|---|---|
| ***B41J 2/01*** | (2006.01) |
| ***B41J 2/385*** | (2006.01) |
| ***G03G 9/08*** | (2006.01) |
| ***G03G 15/20*** | (2006.01) |

(52) U.S. Cl.

USPC ..... 347/156; 347/102; 347/107; 399/337

(58) Field of Classification Search

USPC ..... 347/129, 156, 262, 264

See application file for complete search history.

(56) References Cited

U.S. PATENT DOCUMENTS

| | | | | |
|---|---|---|---|---|
| 4,503,437 | A | 3/1985 | Katzschner | |
| 5,184,152 | A | 2/1993 | French | |
| 5,220,356 | A * | 6/1993 | Yaginuma | 347/225 |
| 5,369,419 | A | 11/1994 | Stephenson et al. | |
| 5,519,426 | A | 5/1996 | Lukis et al. | |
| 6,066,829 | A * | 5/2000 | Ishikawa | 219/121.68 |
| 7,920,279 | B2 | 4/2011 | Ernst et al. | |
| 2002/0159785 | A1 | 10/2002 | Masuda et al. | |
| 2008/0101832 | A1 * | 5/2008 | Yaoi et al. | 399/336 |
| 2009/0245896 | A1 | 10/2009 | Ishikake et al. | |
| 2011/0058869 | A1 | 3/2011 | Kagawa | |
| 2011/0262196 | A1 * | 10/2011 | Maeda | 399/336 |
| 2012/0039643 | A1 | 2/2012 | Chang et al. | |

FOREIGN PATENT DOCUMENTS

| | | |
|---|---|---|
| JP | 61-91678 A | 9/1986 |

OTHER PUBLICATIONS

Chu-heng Liu, U.S. Appl. No. 13/462,485, filed May 2, 2012.
Chu-heng Liu, U.S. Appl. No. 13/539,416, Office Action dated Dec. 19, 2013.
Chu-heng Liu, U.S. Appl. No. 13/597,537, Office Action dated Nov. 5, 2013.

* cited by examiner

*Primary Examiner* — Justin Seo
*Assistant Examiner* — Kendrick Liu
(74) *Attorney, Agent, or Firm* — Ronald E. Prass, Jr.; Prass LLP

(57) ABSTRACT

A system for generating a differential gloss image useful for digital printing includes a digital front end configured for receiving variable image data; and an imaging device including a laser glossing imager, the imaging device being configured to receive raster image data from the digital front end, the raster image data being based on the received variable image data, and the imaging device being configured to generate a differential gloss image over a printed image based on the received variable image data.

15 Claims, 6 Drawing Sheets

METHODS AND SYSTEMS FOR GENERATING DIFFERENTIAL GLOSS IMAGE USEFUL FOR DIGITAL PRINTING

RELATED APPLICATIONS

This application is related to co-pending U.S. patent application Ser. No. 13/462,485 titled "METHODS AND APPARATUS FOR GENERATING DIFFERENTIAL GLOSS IMAGE USING LASER ENERGY," the disclosure of which is incorporated by reference herein in its entirety.

FIELD OF DISCLOSURE

The disclosure relates to methods and systems for producing differential gloss images. In particular, the disclosure relates to methods and systems for producing images on a marking material fixed to a substrate.

BACKGROUND

Gloss is an image or substrate attribute that describes how much specular reflection is observed from a surface of a substrate. Specular reflection is the mirror-like reflection of light from a surface, in which light from a single incoming direction is reflected in a single outgoing direction. Because the surface of the substrate is not always perfectly flat, the light reflected from the surface of the substrate is not similar to what would generally be reflected from a mirror. When a surface of a substrate is rough, the percentage of the light that is reflected as specular reflection is less. In general, the rougher the surface, the lesser the chance of the reflected light is going to travel in the direction of the specular reflection. By varying the roughness of the surface, different types of finishes may be achieved.

A related art gloss technology is used to generate image-wise gloss effect by printing using particular paper, ink, halftones, and manner of fusing the ink onto the paper. By adjusting these parameters, a gloss of the printed image can be modulated, creating a subtle image that may be viewed when the paper is held a certain way. The technology is referred to as glossmark, and is described in US Patent Publication No. 2004/0001233 titled "Protecting Printed items Intended For Public Exchange with Glossmarks" and US Patent Publication No. US2004/0156078 titled "Application of Glossmarks for Graphics Enhancement". Glossmark technology is limited insofar as it can only be used to print images having a limited amount of colors with small contrast.

Another related art technology that may affect a roughness of a surface is laser engraving. Other related art image surface modification methods include laser engraving, which includes marking an object by removing material from a solid surface using a high power laser. Laser engraving requires high energy: power density and energy density. Because of the high energy required, the speed of laser engraving is slow. Further, laser engraving generates fumes and dust, which are neither environmentally nor user friendly. Finally, image resolution of laser engraving is limited.

SUMMARY

Methods and apparatus for creating an image by applying energy to marking material on a substrate are disclosed in U.S. patent application Ser. No. 13/462,485 titled "METHODS AND APPARATUS FOR GENERATING DIFFERENTIAL GLOSS IMAGE USING LASER ENERGY." Methods and systems for creating gloss images by applying energy to marking material on a substrate based on variable data are desired.

In an embodiment, systems for generating a differential gloss image useful for digital printing may include a digital front end configured for receiving variable image data; and an imaging device, the imaging device being configured to receive raster image data from the digital front end, the raster image data being based on the received variable image data. In an embodiment, the imaging device may include a laser glossing imager. In an embodiment, systems may include the laser glossing imager extending a full width of a printed image transported by a media pathway. In an alternative embodiment, systems may include the laser glossing imager extending a partial width of a printed image transported by a media pathway.

In an embodiment, systems may include a user interface for receiving variable image data, the user interface being operably connected to the digital front end. Systems may include the digital front end being configured to process received variable image data to generate raster image data. The digital front end being may be configured to process received variable image data to acquire position information, the position information comprising at least one of x axis position information and y axis position information, the x axis corresponding to a line running parallel to a printed image process direction, and the y axis position information corresponding to a line running perpendicular to a printed image process direction.

In an embodiment, systems may include a print positioning system configured for receiving the position information from the digital front end, the positioning system configured for causing a print transport to adjust a position of a substrate in a direction perpendicular to a process direction of the substrate. In an embodiment, systems may include imager positioning system configured for receiving the position information from the digital front end, and causing the imaging device, e.g., a laser glossing imager, to be positioned for exposing a desired portion of a printed image to radiation based on the y position information. In an embodiment, the imager positioning system may be configured to communicate x position information to the imaging device, and to communicate y position information to the imaging device, the imaging device being configured to emit radiation at one or more times based on the x position information.

In an embodiment, methods of generating a gloss image useful for digital printing may include receiving variable image data at a digital front end; and causing an imaging device to expose at least a portion of a printed image to radiation according to a raster image based on the received variable image data. Methods may include producing raster image data based on the received variable image data; and transmitting the raster image data to the imaging device. Methods may include obtaining positioning information from the received variable image data; and causing the imaging device to expose a portion of a printed image at a firing time, the firing time being based on the obtained position information.

In an embodiment, methods may include determining whether the imaging device is located at a firing position, the firing position being based on the obtained positioning information; and causing the imaging device to be adjusted to the firing position if the imaging is determined not to be located the firing position. Methods may include determining whether the imaging device is located at a firing position, the position being based on the obtained positioning information; and causing the substrate to be adjusted so that the imaging device is located in the firing position. Methods may include causing the substrate to pass the imaging device at a predetermined speed; and detecting a lead edge of the substrate. Methods may include the imaging device comprising a laser glossing imager configured to emit a laser beam at a firing time, the laser beam being configured to melt a portion of a printed image based on the received variable image data. Radiation emitted by the laser glossing imager may be configured to cause the portion of the printed image to melt, altering a gloss of the portion of the printed image.

In an embodiment, methods may include receiving position information at a positioning system from a digital front end; and sending the position information to the imaging device. Methods may include receiving the variable image data at a user interface, the user interface being configured to communicate with the digital front end.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
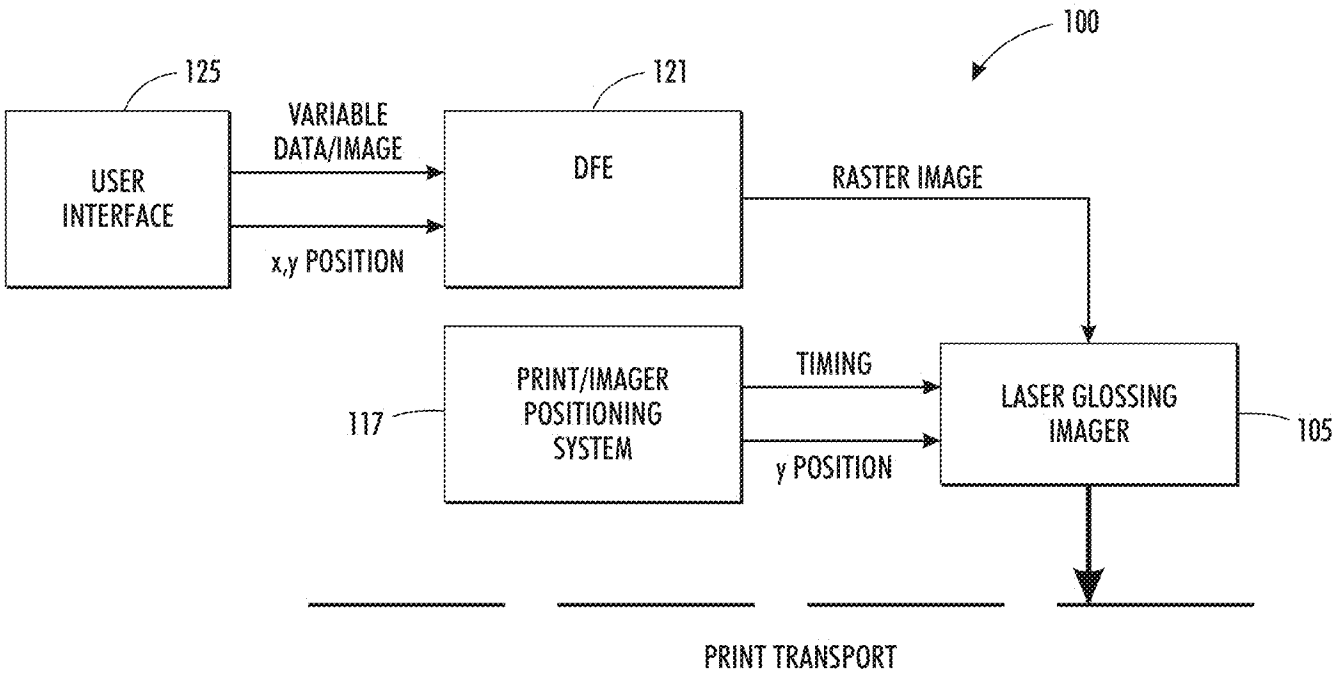
FIG. 1 shows a diagrammatical view of a system for generating a differential gloss image in accordance with an exemplary embodiment.

Exemplary embodiments are intended to cover all alternatives, modifications, and equivalents as may be included within the spirit and scope of the methods and systems as described herein.

Methods for enabling an image production device to generate differential gloss for a print may include exposing a toner image of a material to radiation emitted by an imaging device, such as a high power laser, to cause one or more portions of the toner image to melt. The toner image is disposed on a substrate that remains substantially unaffected by the laser. The one or more portions of the toner image are selectively exposed to, for example, a laser beam emitted by the imaging device based on variable data. In particular, methods may include receiving data at a digital front end (DFE), and generating a differential gloss image on a toner image based on the received data. Methods are useful for generating differential gloss images in variable data printing, a form of digital printing, including on-demand printing, in which elements such as text, graphics, and images may be changed from one print to the next. Methods are useful for digital offset printing, for example.

Systems may include an image production device having a processor and an imaging device or laser glossing imager, which may include a high power laser coupled to the processor. The image production device, laser glossing imager, and/or processor may be coupled to a data source, such as an external data source. The data source may be remotely or locally disposed with respect to the image production device. For example, the image production device may also include a local user interface for controlling its operations, although another source of image data and instructions may include any number of computers to which the printer is connected by way of a network. The image production device may be any device that may be capable of making image production documents (e.g., printed documents, copies, etc.) including a copier, a printer, a facsimile device, and a multi-function device (MFD), for example. The image production device may be a digital printing system configured for printing with lithographic inks, for example.

The high power laser of the laser glossing imager may be configured to melt one or more portions of a toner image on a substrate that remains substantially unaffected by the radiation emitted by the laser glossing imager to alter the surface of the toner image. The energy from the laser applied to the surface of the one or more portions of the toner image transforms the one or more portions from, for example, a substantially flat surface to a rough surface. The one or more portions of the toner image are selectively exposed to, for example, a laser beam emitted by the imaging device based on variable data. In particular, systems may include a digital front end (DFE) for communicating data to the image production device for digital printing. The system may be configured to generate a differential gloss image on a toner image by laser patterning based on the communicated data. Systems are useful for generating differential gloss images in variable data printing, a form of digital printing, including on-demand printing, in which elements such as text, graphics, and images may be changed from one print to the next. Systems are useful for digital offset printing, for example.

The disclosed embodiments may include a computer-readable medium storing instructions for controlling an image production device to generate a print having differential gloss. The instructions may be configured to cause an imaging device to lase or heat select portions of a toner image on a substrate to melt the select portions of the toner image, the pigments of the toner image absorbing the laser energy, for example.

The image production device may include an image production section and a gloss image creation section. When a printed sheet is processed by the image production section, it may then be moved to the gloss image creation section. In an embodiment, a laser glossing imager may be used in the gloss image section to act upon a primary image that has contrast in color or density, to superimpose a secondary image with distinct contrast in gloss. The printed sheet with both a primary color/density image and a secondary gloss image thereon may then be moved an output section, where it may be collated, stapled, folded, etc., with other media sheets in manners familiar in the art.

The image production device may include a bus, a processor, a memory, a read only memory (ROM), a imaging device such as a laser glossing imager, a cooling section, a feeder section, an output section, a digital front end including, for example, a user interface, a communication interface, an image production section, and a scanner. The bus may permit communication among the components of the image production device. The digital front end may be remotely located with respect to the imaging device and/or processor, for example, and may be configured for communicating by wired or wireless connections with components of the image production device. The processor may include at least one conventional processor or microprocessor that interprets and executes instructions. The memory may be a random access memory (RAM) or another type of dynamic storage device that stores information and instructions for execution by a processor. The memory may also include a read-only memory (ROM) which may include a conventional ROM device or another type of static storage device that stores static information and instructions for the processor.

The communication interface may include any mechanism that facilitates network communication. For example, a communication interface may include a modem. Alternatively, communication interface may include other mechanisms for assisting in communications with other devices and/or systems.

ROM may include a conventional ROM device or another type of static storage device that stores static information and instructions for the processor. A storage device may augment the ROM and may include any type of storage media, such as, for example, magnetic or optical recording media and its corresponding drive.

The user interface may include one or more conventional mechanisms that permit a user to input information to and interact with the image production device, such as a keyboard, a display, a mouse, a pen, a voice recognition device, touchpad, buttons, etc., for example. The output section may include one or more conventional mechanisms that output image production documents to the user, including output trays, output paths, finishing section, etc., for example. The image production section may include an image printing and/or copying section, a scanner, a fuser, etc., for example.

The imaging device may be a laser imager or laser glossing imager. The laser glossing imager may include a high power laser source that is configured to provide sufficient laser energy to cause an ink or toner image to melt. For this purpose, the laser glossing imager may serve as a heating device. For example, the laser glossing imager may be used to output the laser power in a certain pattern. This may cause different levels of roughness on the toner image, and therefore may affect a gloss appearance. The laser glossing imager may be a separate module, or may be implemented as part of another module or component of the image production device.

The cooling section may be configured to cool the toner image after the one or more portions of the toner image begin to melt. Although the cooling section is described herein as a separate module, it may be possible that the cooling section may be implemented as part of another module or component of the image production device. For some embodiments, the cooling section may be optional because the cooling may occur naturally as the heat diffuses away quickly from the local heating spot.

The scanner (or image scanner) may be any scanner known to one of skill in the art, such as a flat-bed scanner, document feeder scanner, etc. The image scanner may be a common full-rate half-rate carriage design and can be made with high resolution (600 dpi or greater) at low cost, for example.

The image production device may perform such functions in response to processor by executing sequences of instructions contained in a computer-readable medium, such as, for example, memory. Such instructions may be read into memory from another computer-readable medium, such as a storage device or from a separate device by way of a communication interface.

Although not required, the disclosure will be described, at least in part, in the general context of computer-executable instructions, such as program modules, being executed by the image production device, such as a communication server, communications switch, communications router, or general purpose computer, for example.

Generally, program modules include routine programs, objects, components, data structures, etc. that performs particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Methods and system are useful for generating an image on a toner image. The toner image is on a substrate such as a paper sheet. The substrate may be flexible (e.g., paper, transparency, etc.) The toner image may be a film of certain thickness (e.g., five microns), and may include embedded pigments. The pigments may absorb the laser power, and may reach a high temperature causing the toner image to melt. The substrate may serve as a heat sink that cools down the toner image. The cooling of the toner may also be performed by the cooling section.

Prior to generating a differential gloss image on the toner image, the toner image may have uniform gloss. For example, the material (or combination of the substrate and the toner image) may be a print. For photography or print applications, the common finishes desirable by consumers are glossy finish and matte finish.

In general, differential gloss refers to a glossy finish that may be achieved by providing a contrast of more glossy areas and less glossy areas. For example, surfaces with greater roughness will typically be less glossy. By modulating the surface roughness in an image-wise fashion, an image with distinct gloss contrast can be created. For some embodiments, the imaging device, e.g., a laser glossing imager may be used to concentrate energy onto certain areas of an ink or toner image. The laser may output short pulses of radiation having a power high enough to cause the toner to melt. This may cause the surface of the ink or toner image to become change. Causing the surface of the ink or toner image to change can either increase or decrease gloss of the image, depending on the initial state of the ink/toner material and the amount of laser exposure. For example, a black patch of a print may have a substantial uniform gloss. When the laser glossing imager is applied to selected areas of the black patch, the ink of the areas that are exposed to the laser may become rougher or smoother because of melting and subsequent solidification. The areas of the black patch that are not exposed to the laser may maintain the original gloss. As a result of applying the laser from the laser glossing imager, there may be an image that can be seen as having differential gloss on top of the original printed image. The image on top of the original image may be independent of the underlying original image, and it may be adjusted by varying the laser pattern from the laser glossing imager. It should be noticed that the substrate may remain substantially the same with minimal or no impact caused by the laser from the laser glossing imager.

A laser glossing imager may be configured so that the power of the laser energy emitted from the laser glossing imager is sufficient enough to cause melting of the toner image, while being insufficient to cause evaporation or ablation of the toner image or the substrate. For example, the laser glossing imager may be configured to meet energy requirements of about 1 kW/cm2 (or in a range of 100 to 10000 W/cm2) for power density, and about 1 J/cm2 (or in a range of 0.1 to 10 J/cm2) for energy density. The energy requirements for a laser glossing imager differs from the energy requirements typically associated with laser ablation/engraving techniques where the laser energy is strong enough to be used in etching application of hard materials (e.g., stone, ceramic, etc.). For example, the typical laser energy requirements for laser ablation/engraving may be in a range of 1 to 100 MW/cm2 for power density, and a range of 1 to 100 J/cm2 for energy density, where MW is Mega Watts. In addition, the laser ablation/engraving techniques may cause evaporation or removal of the material, whereas there is minimal or no evaporation or removal of the material caused by the embodiments of the present invention. A laser glossing imager has energy requirements that also differ from that of lower-power laser imagers typically used for electrophotography, as in a laser printer.

An imaging device such as a laser glossing imager may be applied using a combination of a beam and an x-y table. Alternatively, a line exposure of laser may be created in one direction while the substrate may travel in a different direction such as, for example, a direction perpendicular to a toner image and substrate process direction.

FIG. 1 shows a diagrammatical view of a system for generating a differential gloss image in accordance with an exemplary embodiment. In particular, FIG. 1 shows an image production system 100 configured for generating a differential gloss image. The image production system 100 may include an imaging device such as a laser glossing imager 105. The laser glossing imager 105 may be operably disposed adjacent to a media transport pathway. For example, FIG. 1 shows the laser glossing imager disposed above a substrate 115 for emitting a laser beam toward the substrate 115 in the direction of the arrow originating from the laser glossing imager 105.

The system 100 may include a print and/or imager positioning system 117. The print/imager positioning system 117 as shown is configured to communicate timing, or x position data with respect to a substrate 115 process direction, and y position data. The y position data relates to, for example, a position along a y axis perpendicular to x axis or substrate 115 process direction. The timing, or x position data may relate to a position on an x axis, parallel with a process direction. For example, x position data may include data based on which a laser glossing imager outputs a beam at a particular time. The output or firing time of the laser may be an elapsed time with respect to a print run start or a detection of a substrate passing a particular point along the media transport pathway.

The y position data may include information for determining where to position the imaging device and/or the substrate carrying the toner image with respect to each other. Systems configured to implement y position data-based adjustment typically do not include full-width imagers. For example, either or both of the imaging device and the media path transporting the substrate may be configured to be adjustable. Either the positioning system 117 or the laser glossing imager 105 may cause the adjustment based on timing and/or y position data received by the positioning system 117. The positioning system 117 or the media transport system (not shown) may cause the adjustment based on timing and/or y position data received by the positioning system 117. For example, the media transport may adjust a transport speed and/or adjust a substrate position in a direction perpendicular to the process direction, i.e., parallel to the y axis. Accordingly, y position and/or x position or timing information may be used to cause the imaging device 105 to alter a surface of a toner image on a substrate 115 at specified locations on the toner image. A differential gloss image with high resolution and strong contrast may be thereby produced.

In an embodiment, a full width laser glossing imager may be implemented for image-wise exposing marking on a substrate to radiation based on x position data, the laser glossing imager extending the width of the substrate, for example. As such, systems including a full-width imager, it may not be necessary to rely on y position data for printing.

A laser glossing imager requires, however, a high power laser, and imaging speed and laser glossing imaging width is limited by power requirements. For fixed laser power, an imaging area per unit time (which equals imaging speed * image exposure width) remains constant. Thus, a full-width imager is limited by imaging speed. To laser gloss an image to produce a differential gloss image on a printed image on a substrate at a reasonable speed, e.g, a speed comparable to typical image production systems such as electrophotographic printers, a narrow laser glossing imager may be used. The laser glossing imager may be narrower than a typical, e.g., imager of a document printer. As such, y position data and x position or timing data may be used for imager positioning. The laser glossing imager may be configured for exposing a small width of marking material printed on a substrate that is about 1 cm. Such preferred embodiments are desirable at least for cost reduction due to the smaller imager, relative to typical printing systems, and for the simplicity of using a single laser for the imaging device or system. While embodiments configured with a full-width imager may be used for laser glossing an image to produce a full-width differential gloss image, embodiments configured with a less than full-width imager may be useful for security application. A less than full-width laser glossing imager may be used to place a "stamp" or "stripe" on a printed image for security applications, for example.

System 100 may include a digital front end (DFE) 121 configured for receiving variable data/image data. The DFE 121 may be configured to convert variable data/image data input into raster image data suitable for processing by the print/imager positioning system 117. The DFE 121 may be configured to acquire and process positioning information. The DFE 121 may be configured to transmit the variable data/image data in the form of raster image data to the imaging device 105. The DFE may be configured to transmit the positioning information to the print/imager positioning system 117.

The DFE may be configured to receive positioning information and/or variable data/image data from a user interface 121. The user interface may be located at the DFE, or remotely located and connected by wireless or wired communications lines. The user interface may be any suitable user interface now known or later developed, including keyboard/keypad, touchscreen, voice-command, etc.

Figure 2:
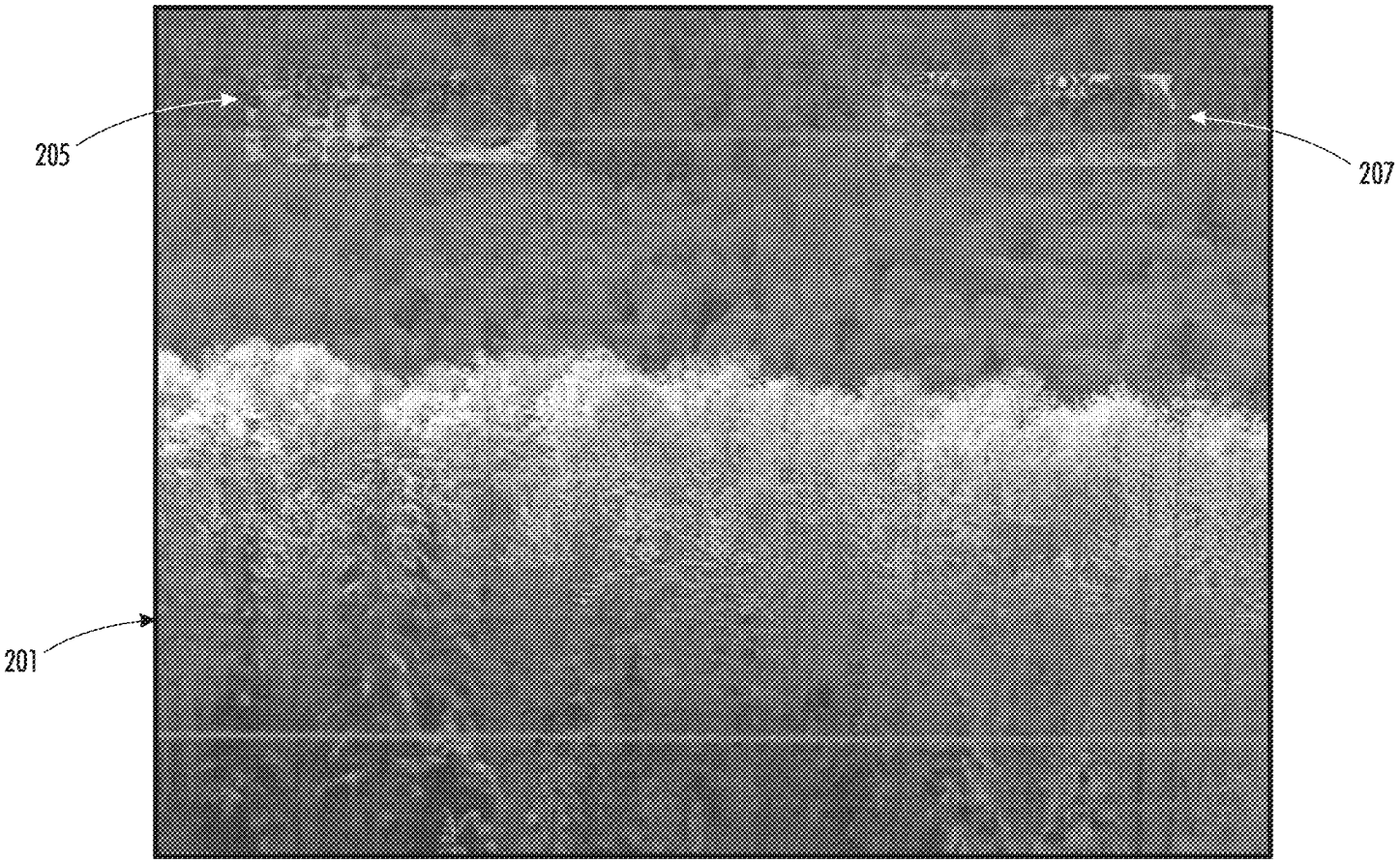
FIG. 2 shows an image having a differential gloss image generated by methods and a system in accordance with an exemplary embodiment.

FIG. 2 shows an image having a differential gloss image generated by methods and a system in accordance with an exemplary embodiment. In particular, FIG. 2 shows a toner image 201 formed on a substrate such the substrate 115 of FIG. 1. The toner image 201 includes a first gloss image 205 and a second gloss image 207. The first laser gloss image 205 and the second gloss image 207 were generated by a laser glossing imaging device that remained in a constant position along the y axis during printing. The first gloss image 205 and the second gloss image 207 are located at different positions along the x axis, and produced by emitting a laser at two different firing times during gloss image creation.

Figure 3:
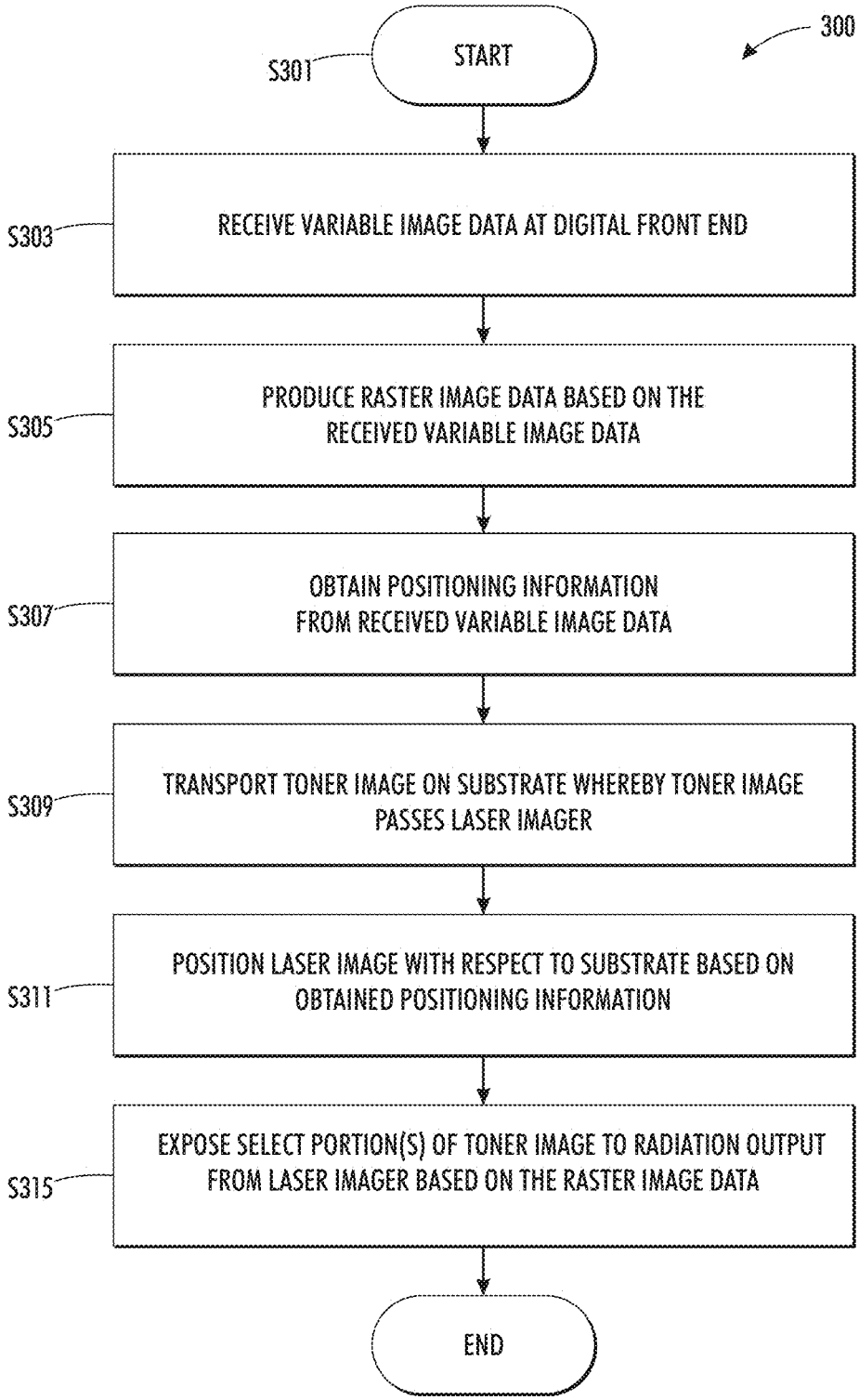
FIG. 3 shows methods for generating a differential gloss image based on variable data in accordance with an exemplary embodiment.

FIG. 3 shows methods for generating a differential gloss image based on variable data in accordance with an exemplary embodiment. In particular, FIG. 3 shows a method S300 that starts at S301. The method includes receiving variable image data at a DFE. The DFE may communicate with a user input to receive image data form a local and/or remote location. The variable image data may include positioning information and image data that may be converted to raster image data.

Methods may include producing raster image data based on the received variable image data at S305. Methods may include obtaining positioning information from the received variable image data at S307. The positioning information may include timing or x position information and/or y position information. For example, systems may implement positioning information including x position and y position data for systems implementing a laser glossing imager that having a width that is less than a full width of a printed image on a substrate. For systems implementing a full-width laser glossing imager, x position or timing position may be used for exposing a printed image to radiation at specified times to produce a differential gloss image, although at a lower print speed than that achievable by systems implementing a preferred less than full width laser glossing imager.

Methods may include transporting a toner image on a substrate by way of a substrate transport system. The substrate transport system may be configured to carry a substrate to pass an imaging device or laser glossing imager at a desired speed. Methods may include transporting the toner image at S309 as shown in FIG. 3.

The laser glossing imager may be positioned for altering rheological properties of a toner image at a desired portion(s) of the toner image at S311. Methods may include determining whether a laser glossing imager is positioned for exposing a desired portion of a toner image to radiation. If a laser glossing imager is not initially at a desired position for exposing a desired portion of the toner image, the laser glossing imager may be moved to a position that is appropriate for exposing the desired portion of the toner image before outputting the laser beam. The laser glossing imager may be moved in a direction perpendicular to a process direction of a media transport pathway. Alternatively, or in combination, the media transport pathway may be constructed for moving the substrate with respect to the laser glossing imager for positioning the substrate as desired for exposing particular portion(s) of a toner image on the substrate.

Methods may include exposing at S315 select portions of the toner image to radiation output from the laser glossing imager according to raster image data received from the DFE. The laser glossing imager firing times may be based on position information received from the DFE. For example, based on x or timing position information, the laser glossing imager be controlled emit a laser beam at a specific time with respect to, for example, detection of a lead edge of a substrate such as a cut sheet.

Figure 4:
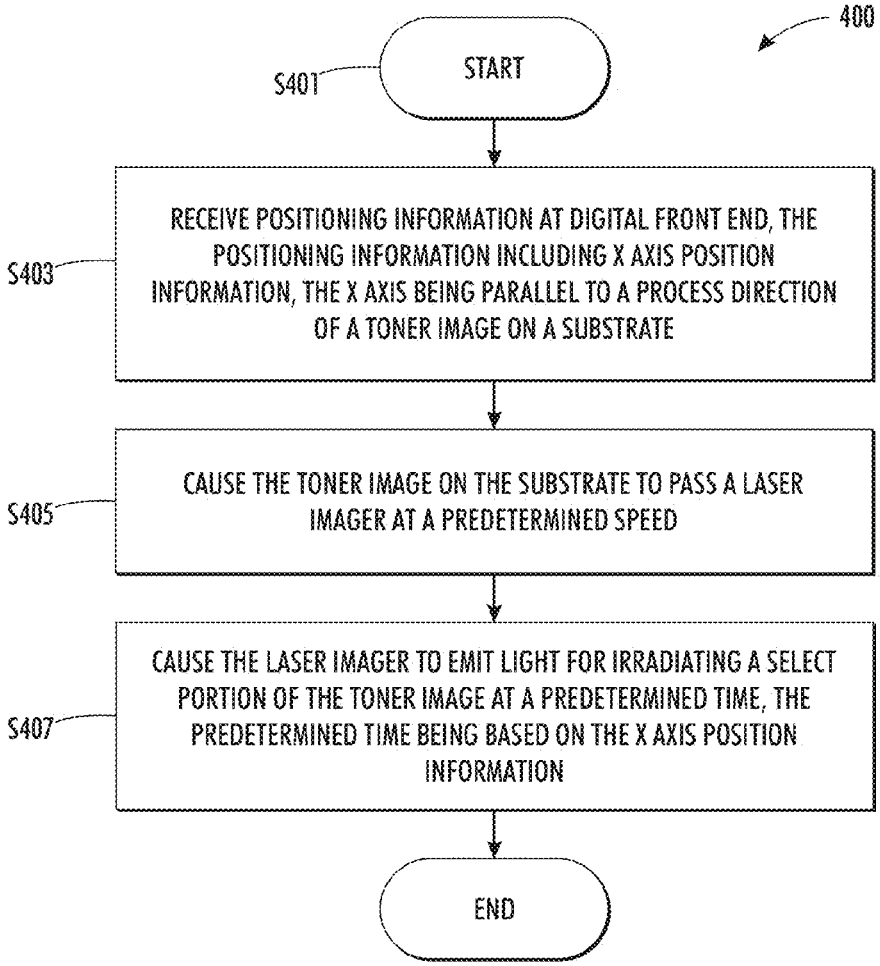
FIG. 4 shows methods for generating a differential gloss image based on variable data in accordance with an exemplary embodiment.

FIG. 4 shows methods for generating a differential gloss image based on variable data in accordance with an exemplary embodiment. In particular, FIG. 4 shows a method 400 that starts at S401. Methods may include receiving positioning information at a DFE. The positioning information may include x axis position information, the x axis being an axis running parallel to a toner image and substrate or media transport process direction.

Methods may include causing the toner image on the substrate to pass a laser glossing imager at a predetermined speed at S405. The speed of transport may be constant. At S407, the laser glossing imager may be caused to emit light for irradiating a select portion of the toner image at a predetermined time. The predetermined time may be based on position information received from the DFE. The position information may be x or timing position data that corresponds to a received raster image according to which the laser glossing imager will mark the toner image. For example, the laser glossing imager may be caused to fire a laser beam at a time elapsed from a detection of a lead edge of a sheet carrying a toner image, the elapsed time being based on the received x position information.

Figure 5:
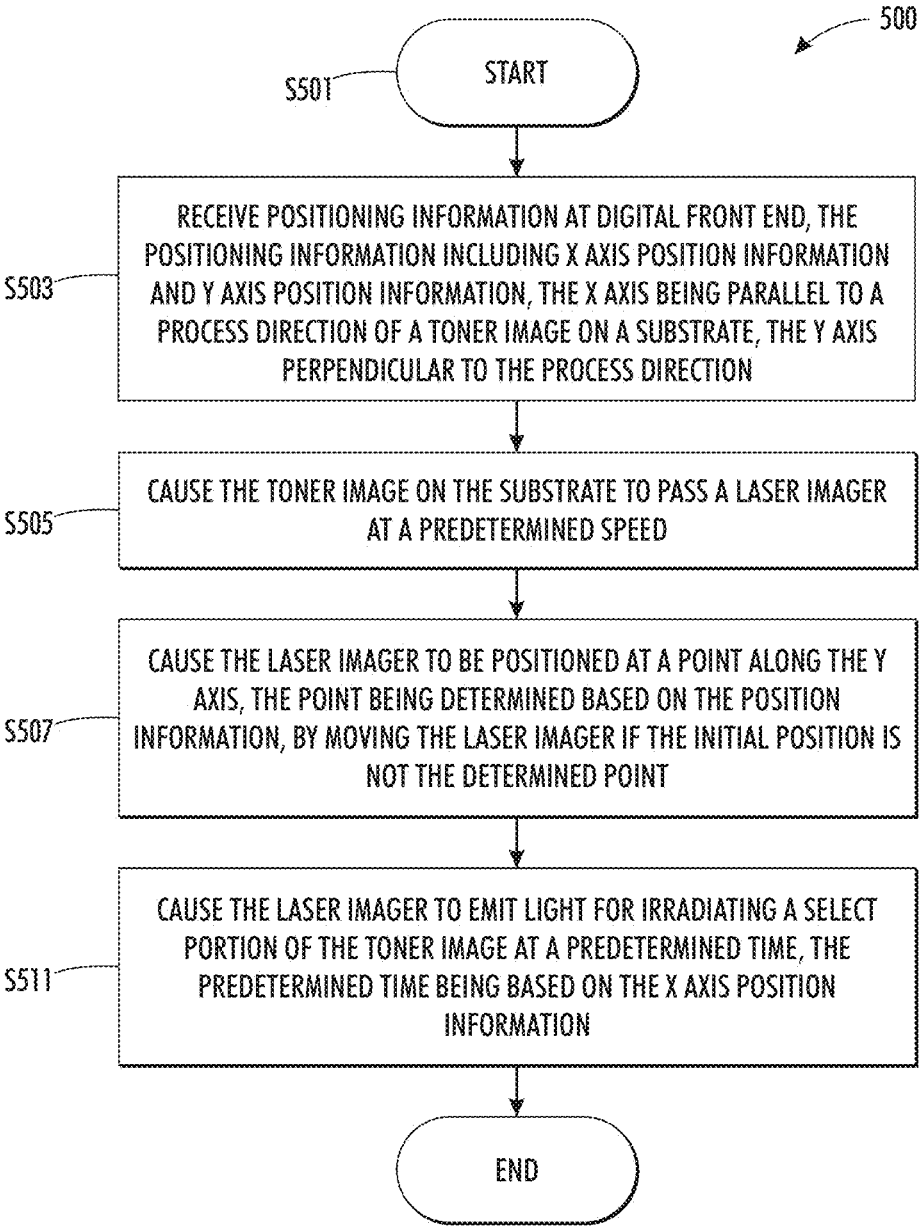
FIG. 5 shows methods for generating a differential gloss image based on variable data in accordance with an exemplary embodiment.

FIG. 5 shows methods for generating a differential gloss image based on variable data in accordance with an exemplary embodiment. In particular, FIG. 5 shows a differential gloss image generating method 500 that starts at S501. Methods may include receiving position information at a DFE. The positioning information may include x axis position information and y axis position information. The position information may be received at a user interface configured for communicating with components of the DFE. The x axis position information or timing information may be received by a laser glossing imager from the DFE, by way of a print/imager positioning system. The laser glossing imager also receives a raster image produced by the DFE based on received variable image data. The raster image data and corresponding position information may be received by a DFE as variable image data by input by a user. The DFE may process the variable image data to determine position information and produce a raster image.

The imager may be configured to receive positioning information from the positioning system, including the x and y positioning information. The laser glossing imager may be adjustable positioned, and configured to accommodate adjustment based on received positioning information. For less-than-full-width imagers, y positioning information may be used to cause the laser glossing imager to remain at or move to a desired location before exposing a toner image on a substrate. The x axis position information may be used to cause the laser glossing imager to fire at a specified time to apply a marking to a toner image at a desired location. Alternatively, systems may implement an adjustable media pathway for adjusting a position of the substrate with respect to the imaging device based on position information.

Methods may include causing the toner image on the substrate to pass a laser glossing imager at a predetermined speed at S505. The media pathway may alternatively, or combination, be equipped with one or more optical sensors for detecting a substrate, e.g., a lead edge sheet sensor, wherein methods may include sensing or detecting, e.g., a lead edge of a substrate.

Methods may include causing at S507 the imaging device, e.g., laser glossing imager to be positioned at a point along the y axis, the point being determined based on the position information. In particular, the laser glossing imager may be positioned for generating a differential gloss image by exposing a desired portion of a toner image on a substrate. If the laser glossing imager is not initially in a position for exposing the desired portion of the toner image, the laser glossing imager may be moved along the y axis until positioned as necessary.

The laser glossing imager may be caused at S511 to emit light for irradiating a select portion of the toner image at a predetermined time, the predetermined time being based on the x axis position information. For example, the laser glossing imager may be caused to emit light for exposing a select portion of the toner image at a predetermined time, the time being an elapsed time from a time of detecting a lead edge of a substrate transported by a media or substrate transport system.

Figure 6:
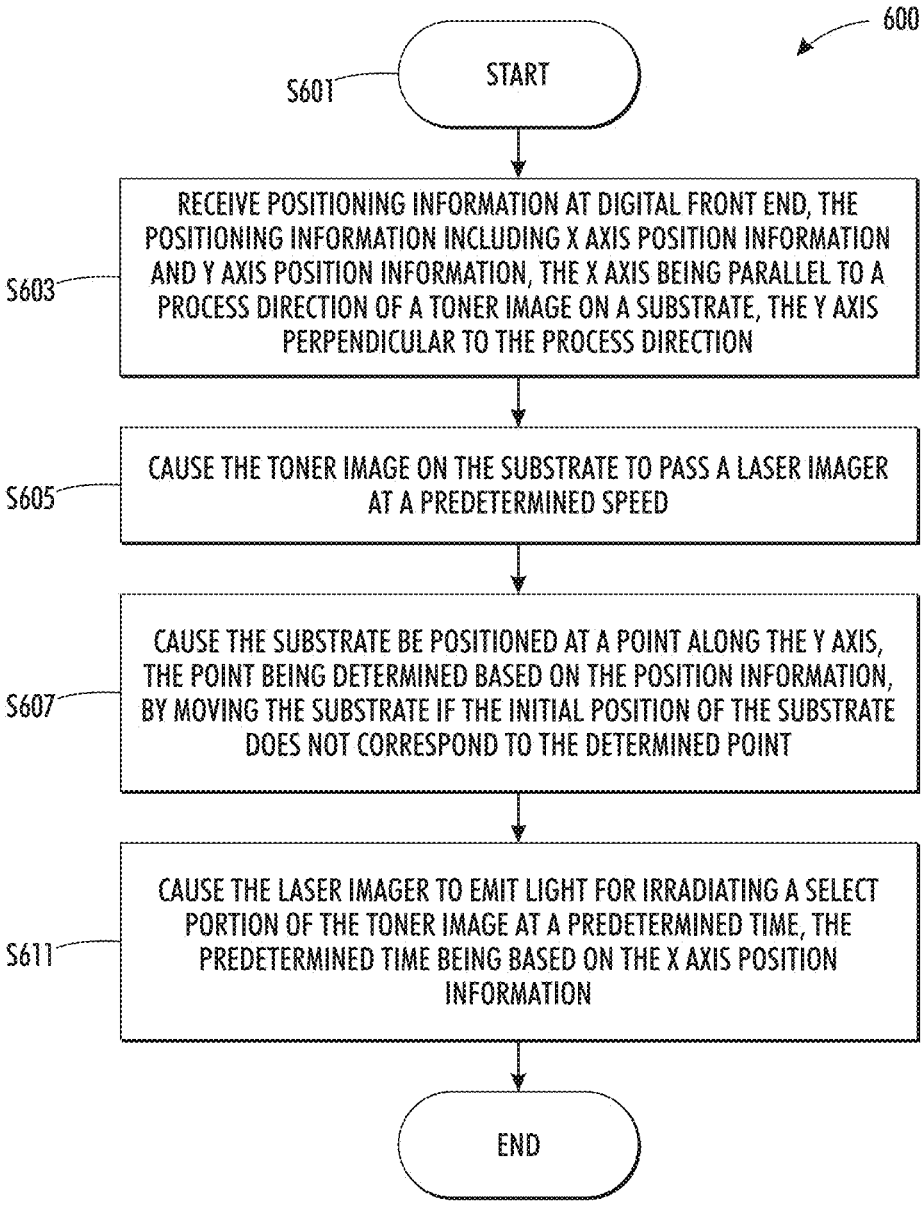
FIG. 6 shows methods for generating a differential gloss image based on variable data in accordance with an exemplary embodiment.

FIG. 6 shows methods for generating a differential gloss image based on variable data in accordance with an exemplary embodiment. In particular, FIG. 6 shows a differential gloss image generating method 600 that starts at S601. Methods may include receiving position information at a DFE. The positioning information may include x axis position information and y axis position information. The position information may be received at a user interface configured for communicating with components of the DFE. The x axis position information or timing information may be received by a laser glossing imager from the DFE, by way of a print/imager positioning system. The laser glossing imager also receives a raster image produced by the DFE based on received variable image data. The raster image data and corresponding position information may be received by a DFE as variable image data by input by a user. The DFE may process the variable image data to determine position information and produce a raster image.

The imager may be configured to receive positioning information from the positioning system, including the x and y positioning information. The laser glossing imager may be adjustably positioned and configured to accommodate adjustment based on received positioning information. For less-than-full-width imagers, y positioning information may be used to cause, for example, the laser glossing imager to remain at or move to a desired location before exposing a toner image on a substrate. The x axis position information may be used to cause the laser glossing imager to fire at a specified time to apply a gloss effect to a toner image at a desired location. Systems may implement an adjustable media pathway for positioning the substrate and toner image with respect to the imaging device based on the position information.

Methods may include causing the toner image on the substrate to pass a laser glossing imager at a predetermined speed at S605. The media pathway may alternatively, or in combination, be equipped with one or more optical sensors for detecting a substrate, e.g., a lead edge sheet sensor, wherein methods may include sensing or detecting, e.g., a lead edge of a substrate.

Methods may include causing at S607 the substrate to be positioned at a point along the Y axis, the point being determined based on the position information. In particular, the substrate may be moved or adjusted in a y axis direction, with respect to a substrate/toner image process direction, by a media transport system for generating a differential gloss image by exposing a desired portion of a toner image on a substrate. If the substrate is not initially in a position for exposing the desired portion of the toner image, the substrate may be moved along the y axis until positioned as necessary.

The laser glossing imager may be caused at S611 to emit light for irradiating a select portion of the toner image at a predetermined time, the predetermined time being based on the x axis position information. For example, the laser glossing imager may be caused to emit light for exposing a select portion of the toner image at a predetermined time, the time being an elapsed time from a time of detecting a lead edge of a substrate transported by a media or substrate transport system.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A system for generating a differential gloss image useful for digital printing, comprising:

a digital front end configured for receiving variable image data;

an imaging device, the imaging device being configured to receive raster image data from the digital front end, the raster image data being based on the received variable image data, the imaging device including a laser glossing imager, the laser glossing imager being configured to expose a portion of a first image on a substrate to radiation to form a second image, the second image overlaying the first image, wherein the digital front end is configured to process received variable image data to acquire position information, the position information comprising at least one of x axis position information and y axis position information, the x axis corresponding to a line running parallel to a printed image process direction, and the y axis position information corresponding to a line running perpendicular to a printed image process direction, and a print positioning system configured for receiving the position information from the digital front end, the positioning system configured for causing a print transport to adjust a position of a substrate in a direction perpendicular to a process direction of the substrate.

2. The system of claim 1, comprising:

a user interface for receiving variable image data, the user interface being operably connected to the digital front end.

3. The system of claim 1, the digital front end being configured to process received variable image data to generate raster image data.

4. The system of claim 1, comprising:

an imager positioning system configured for receiving the position information from the digital front end, and causing the imaging device to be positioned for exposing a desired portion of a printed image to radiation based on the y position information.

5. The system of claim 4, the imager positioning system being configured to communicate x position information to the imaging device, and to communicate y position information to the imaging device, the imaging device being configured to emit radiation at one or more times based on the x position information.

6. A method of generating a gloss image useful for digital printing, comprising:

receiving variable image data at a digital front end; and causing an imaging device to expose at least a portion of a first printed image to radiation according to a raster image based on the received variable image data, whereby a second printed image is formed over the first printed image, wherein the digital front end is configured to process received variable image data to acquire position information, the position information comprising at least one of x axis position information and y axis position information, the x axis corresponding to a line running parallel to a printed image process direction, and the y axis position information corresponding to a line running perpendicular to a printed image process direction, wherein a print positioning system receives the position information from the digital front end, the positioning system configured for causing a print transport to adjust a position of a substrate in a direction perpendicular to a process direction of the substrate.

7. The method of claim 6, comprising:

producing raster image data based on the received variable image data; and transmitting the raster image data to the imaging device.

8. The method of claim 6, comprising:

obtaining positioning information from the received variable image data; and causing the imaging device to expose a portion of a printed image at a firing time, the firing time being based on the obtained position information.

9. The method of claim 8, comprising:

determining whether the imaging device is located at a firing position, the firing position being based on the obtained positioning information; and causing the imaging device to be adjusted to the firing position if the imaging is determined not to be located the firing position.

10. The method of claim 8, comprising:

determining whether the imaging device is located at a firing position, the position being based on the obtained positioning information; and causing the substrate to be adjusted so that the imaging device is located in the firing position.

11. The method of claim 8, comprising:

causing the substrate to pass the imaging device at a predetermined speed; and detecting a lead edge of the substrate.

12. The method of claim 6, the imaging device comprising a laser glossing imager configured to emit a laser beam at a firing time, the laser beam being configured to melt a portion of a printed image based on the received variable image data.

13. The method of claim 6, comprising:

receiving position information at a positioning system from a digital front end; and sending the position information to the imaging device.

14. The method of claim 6, comprising:

receiving the variable image data at a user interface, the user interface being configured to communicate with the digital front end.

15. The method claim 6, whereby the radiation causes the portion of the printed image to melt, altering a gloss of the portion of the printed image.

* * * * *